US005664964A

United States Patent [19]

Crofoot et al.

[11] Patent Number: 5,664,964

[45] Date of Patent: Sep. 9, 1997

[54] HIGH DENSITY TERMINATION SYSTEM WITH MOLDED-ON STRAIN RELIEF FRAME, AND METHOD

[75] Inventors: Larry M. Crofoot, Perry; Alan L. Roath, Madison, both of Ohio

[73] Assignee: Ohio Associated Enterprises, Inc., Painesville, Ohio

[21] Appl. No.: 630,518

[22] Filed: Apr. 10, 1996

[51] Int. Cl.[6] ..... H01R 9/07

[52] U.S. Cl. ..... 439/495; 439/606

[58] Field of Search ..... 439/606, 736, 439/493, 499, 495, 492

[56] References Cited

U.S. PATENT DOCUMENTS

| | | | |
|---|---|---|---|
| 3,961,834 | 6/1976 | Venaleck et al. | 439/76.1 |
| 4,030,799 | 6/1977 | Venaleck | 439/405 |
| 4,310,218 | 1/1982 | Webster et al. | 439/606 |
| 4,547,028 | 10/1985 | Morgan et al. | 439/736 |
| 4,639,058 | 1/1987 | Morgan | 439/493 |
| 4,679,870 | 7/1987 | Pretchel | 439/493 |
| 4,793,060 | 12/1988 | Pretchel | 439/493 |
| 4,798,544 | 1/1989 | Hartman | 439/606 |
| 4,863,402 | 9/1989 | Balck et al. | 439/736 |
| 4,880,388 | 11/1989 | Beamenderfer et al. | 439/495 |

*Primary Examiner*—Gary F. Paumen

*Attorney, Agent, or Firm*—Renner, Otto, Boisselle & Sklar, P.L.L.

[57] ABSTRACT

A termination for a plurality of electrical conductors of a substrate includes a strain relief frame molded to the substrate, a connector housing having a plurality of electrical terminals positioned with respect to the frame to orient the terminals with respect to the conductors, and a plurality of the terminals being electrically connected to respective electrical conductors, the connections being made subsequent to the molding of the strain relief to the substrate. A cable termination assembly made by the process of molding a strain relief to a substrate having plural conductors in positional relation, said molding including leaving exposed connecting portions of respective conductors, subsequently attaching plural terminals respectively to exposed connecting portions of said conductors. A method of making a termination assembly includes molding a strain relief to a substrate having plural conductors in positional relation, said molding including leaving exposed connecting portions of respective conductors, subsequently attaching plural terminals respectively to exposed connecting portions of said conductors.

54 Claims, 8 Drawing Sheets

HIGH DENSITY TERMINATION SYSTEM WITH MOLDED-ON STRAIN RELIEF FRAME, AND METHOD

TECHNICAL FIELD

The invention relates to the terminating of electrical conductors and, more particularly, to a high density termination system with molded-on strain relief frame, and a method of making the system.

BACKGROUND

In the terminating of relatively high density arrangement of electrical conductors supported by a substrate, such as the dielectric material or insulation of an electrical cable, a circuit board, or some other substrate, terminals sometimes referred to as contacts are connected to the respective conductors and then a strain relief mechanism is provided. The terminals have contacting portions to connect to some external device, such an electrical connector, circuit board, etc., and to be removed from such connection. The strain relief prevents the application of force that would damage the connection between respective terminals and electrical conductors.

In the description here reference will be made to termination system. A termination system is the terminals and strain relief used to terminate one or more electrical conductors to facilitate connecting them to another member, external device, etc., such as, for example, a connector, circuit board or the like. An example of a termination system is a cable termination, which is such a system used to terminate the electrical conductors of an electrical cable. Another example of a termination system is one used to terminate the conductors of a circuit board, such as the conductors on or in such a circuit board. Reference herein to a termination assembly is indicative of the termination system in combination with the device being terminated, such as the electrical conductors of a cable, circuit board, etc. Sometimes such a termination assembly is referred to as a cable termination assembly when used to terminate the one or more electrical conductors of an electrical cable; however, such reference also is intended herein to include the terminating of the conductors of a circuit board or other device.

An example of a termination system for a circuit board is disclosed in U.S. Pat. No. 3,961,834. Examples of cable termination assemblies including a molded-on strain relief are disclosed in U.S. Pat. Nos. 4,030,799 and 4,863,402, both of which include insulation displacement connections (IDC) between respective contacts and cable conductors. Another cable termination system in the form of a clip type connector in which cable conductors are exposed, deformed, and connected to respective terminals, the area of connection being included within a molded connector/strain relief body, is disclosed in U.S. Pat. No. 4,679,870. The disclosures of the above patents are incorporated in their entirety by reference.

A number of problems have been encountered in the past when terminating the conductors of a flat flexible circuit or flat flexible cable (sometimes referred to as FFC or as a "flex" circuit), an etched circuit, and other devices in which the conductors are arranged at very close spacing and in which the dielectric material may be relatively fragile, not able to withstand high temperature, etc. For example, some dielectric (insulation) and/or adhesive materials, such as polyester, may not be able to withstand the high temperatures encountered during the plastic injection molding process by which the strain relief body is formed. Melting or other destruction of the integrity of such dielectric materials will reduce or eliminate the function of retaining the electrical conductors thereof in fixed positional relation. As a result, conductors may touch, causing a short circuit or conductors may be misaligned so that they will not properly connect with terminals intended to be attached thereto as part of the termination system. Another source of heat that may result in a releasing of the conductors from being held in fixed relative positions is the heat developed by securing the conductors and terminals, such as that generated by welding or soldering, such as bar soldering or induction soldering. Additionally, the flowing plastic or other material that are injection molded to form the strain relief body may tend to urge the conductors out of position, possibly resulting in a short circuit and/or open circuit where terminals are intended to connect with respective conductors.

To try to avoid the above problems in the past, the strain relief was attached mechanically, e.g., by adhesive, and/or was formed by potting techniques. However, these techniques required a relatively large number of steps and time to make the termination system and, therefore, was relatively expensive.

Some prior techniques for terminating electrical conductors of a cable or some other substrate usually involve one or more steps for preparing the cable/wire, one or more steps for terminating the conductors, as by connection to respective electrically conductive terminals (contacts), and subsequently protecting the connections by molding a strain relief to the cable and terminals. Sometimes the terminals have been preliminarily retained on a dielectric carrier, which is encased in the molded strain relief after corrections have been made between respective conductors and terminals.

Another disadvantage to such prior termination systems has been the relatively high profile of the termination system. Examples are presented in the above-mentioned patents. The above-mentioned problems are encountered when such processes are carried out.

With the foregoing in mind, then, it would be desirable to facilitate and/or to expedite the terminating of a multiconductor device, especially one having a relatively high density arrangement of conductors.

Also, it would be desirable to improve the yield of high density termination systems by avoiding short and/or opens, e.g., between conductors and terminals.

Further, it would be desirable to facilitate the accurate terminating use of relatively inexpensive multiconductor devices, such as FFCs, made of relatively low melting point dielectric materials.

SUMMARY

Briefly, according to one aspect of the present invention, a strain relief body is molded to a plurality of electrical conductors that have been prepared for connection to respective terminals but have not yet been connected to those, terminals; and subsequently connections are made to the respective terminals.

According to another aspect, a plurality of conductors are prepared for connection to respective terminals, a strain relief body is molded to the conductors and holds them in positional relation, and subsequently a termination, such as the terminals or a housing or connector containing the terminals, is coupled to the conductors and strain relief.

Another aspect relates to the molding of a strain relief to a plurality of conductors of a substrate, such as a cable, circuit board or other substrate, to provide physical barriers between respective conductors, and subsequently soldering or otherwise connecting conductors to terminals while the barriers block misdirected flow of solder or the like to avoid short circuits and the like.

Another aspect relates to the molding of a strain relief to a plurality of conductors of a substrate, such as a cable, circuit board or other substrate, to provide physical barriers between respective conductors, and using the barriers to define data sites for aligning of terminals with respective conductors.

Another aspect relates to the expediting of the process for manufacturing a termination assembly by reducing the number of steps required to manufacture the same.

Another aspect relates to a method of terminating a plurality of electrical conductors by molding a body directly thereto while clamping the conductors in relatively fixed relation during the molding process.

Another aspect relates to a termination for a plurality of electrical conductors of a substrate, including a strain relief frame molded to the substrate, a connector housing having a plurality of electrical terminals positioned with respect to the frame to orient the terminals with respect to the conductors, and a plurality of the terminals being electrically connected to respective electrical conductors.

An additional aspect relates to a termination assembly, including a substrate, plural spaced apart conductors carried by the substrate, the conductors having exposed portions for electrical connection, a strain relief body molded to hold the conductors in relatively fixed positional relation, an open area in the strain relief body for exposing connecting portions of the conductors, plural terminals having a connecting portion for connecting with respective exposed portions of the conductors, and the strain relief body including spacers for guiding respective terminal connecting portions to connection with respective conductors and for physically separating respective connecting portions at the area of such connections.

A further aspect relates to a termination assembly, including a substrate, plural spaced apart conductors carried by the substrate, the conductors having exposed portions for electrical connection, a strain relief body molded to hold the conductors in relatively fixed positional relation, an open area in the strain relief body for exposing connecting portions of the conductors; plural terminals having a connecting portion for connecting with respective exposed portions of the conductors, and the electrical conductors being in spaced parallel relation, the strain relief body including a plurality of spacers arranged in a pair of respective parallel rows generally transverse to the parallel directional extent of the electrical conductors for guiding respective terminals into alignment for connection with respective electrical conductors.

Even another aspect relates to a cable termination assembly made by the process of molding a strain relief to a substrate having plural conductors in positional relation, the molding including leaving exposed connecting portions of respective conductors, and subsequently attaching plural terminals respectively to exposed connecting portions of the conductors.

Even an additional aspect relates to a low profile high density termination assembly, including a substrate having plural electrical conductors in a pattern, a strain relief body molded to the substrate, a plurality of electrical terminals having connecting portions, and plural slots in the strain relief body for guiding respective connecting portions to connection with respective electrical conductors while separating respective connecting portions.

Even a further aspect relates to a method of making a termination assembly, including molding a strain relief to a substrate having plural conductors in positional relation, the molding including leaving exposed connecting portions of respective conductors, and subsequently attaching plural terminals respectively to exposed connecting portions of the conductors.

Still another aspect relates to the deforming of a conductor, such as a conductor trace, in an electrical termination to provide space for re-flowed solder and, thereby, to control solder flow, for example, to avoid short circuits and the like.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be suitably employed.

Although the invention is shown and described with respect to one or more preferred embodiments, it is obvious that equivalents and modifications will occur to others skilled in the art upon the reading and understanding of the specification. The present invention includes all such equivalents and modifications, and is limited only by the scope of the claims.

DESCRIPTION

Figure 1:
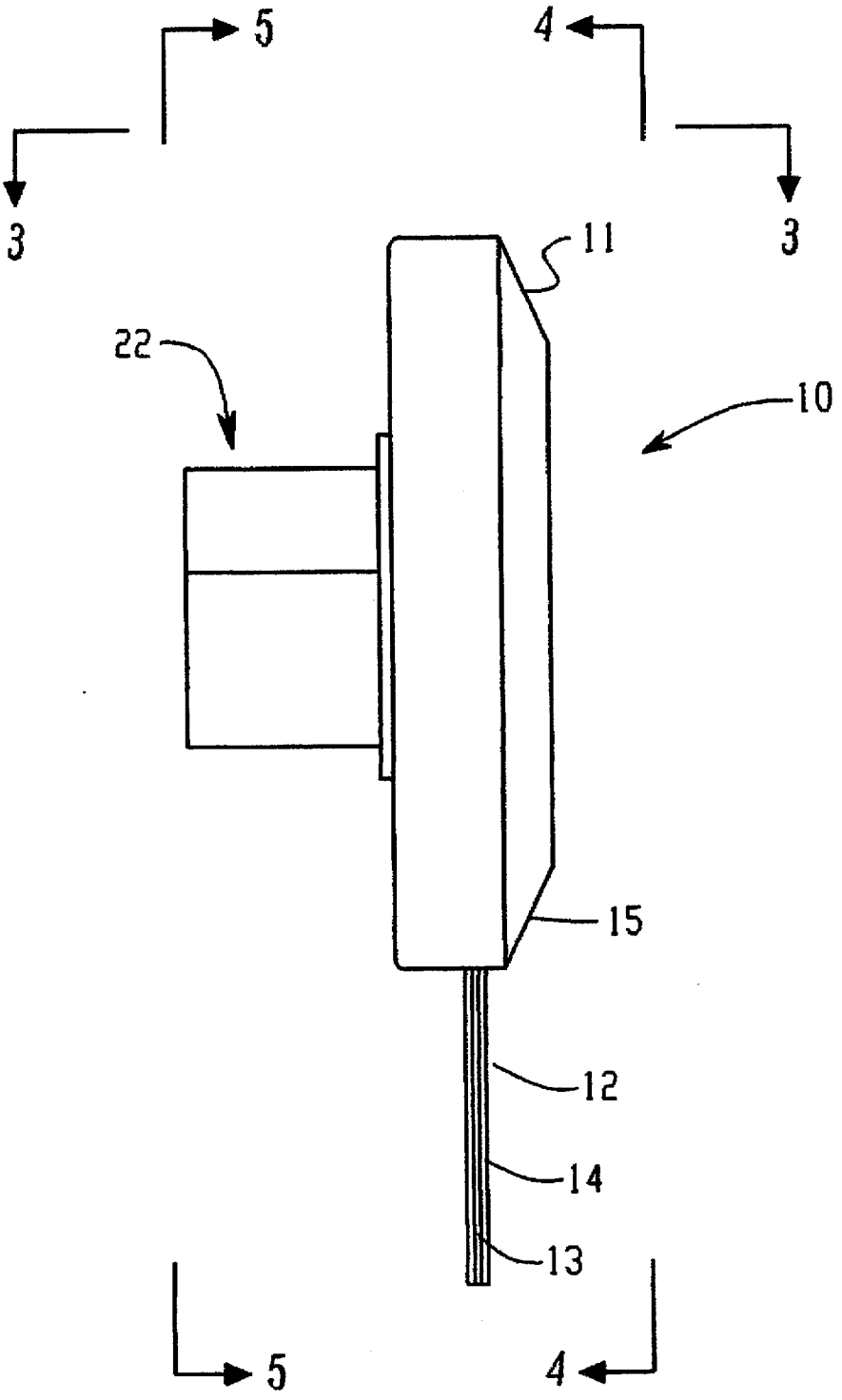
FIG. 1 is a side elevation view of a cable termination assembly in accordance with the present invention.

Referring in detail to the drawings, wherein like reference numerals designate like parts in the several figures, and initially to FIGS. 1–7, a termination assembly in accordance with the present invention is shown in 10. The termination assembly includes a termination system 11 and a multiconductor electrical cable 12, which is terminated by the system 11. Accordingly, the termination assembly 10 may be referred to herein as a cable termination assembly and the termination system 11 as a cable termination; however, it will be appreciated that the assembly 10 and system 11 may be used to terminate other devices, such as, for example, electrical conductors of a circuit board or some other device.

The cable 12 includes a plurality of electrical conductors 13 arranged in a parallel, coplanar, spaced-apart relation in a substrate of dielectric material 14. In one embodiment the cable 12 is an FCC. Alternatively, the conductors may be part of an etched circuit, of a circuit board or of some other substrate.

According to an embodiment of the invention the termination assembly 10 is formed by molding a strain relief body 15 to the cable 12, and more particularly, the electrical conductors 13 thereof. The conductors 13 include connecting portions 20 which are sufficiently exposed in the strain relief body 15 for connecting to respective terminals 21 after the strain relief body 15 has been molded or otherwise formed.

The terminals are of a type and are arranged in position to make connection with another device, such as an electrical connector, contacts or conductors on a circuit board, etc. The particular style of the terminals 21 and the arrangement of them in a connector portion 22 of the termination assembly may be configured in a variety of ways corresponding to the device to which the termination assembly 10 is to be connected.

The molding of the strain relief body 15 prior to attaching terminals 21 to the cable conductors 13 provides several advantages in manufacturing and quality improvements in the termination assembly 10. Such molding fixes the conductors 13 in position for accuracy of connections that are to be made subsequently to the terminals 21. Molding also provides data sites for locating connecting portions of the terminals with respect to the electrical conductors for connection thereto. Further, the molding may provide a barriers between areas of respective connections of terminals 21 to electrical conductors 13 to prevent solder or other securing material from flowing laterally and connecting to an unintended terminal or conductor.

During molding the conductors can be clamped in relative positions, as is described further below. If the dielectric material has a relatively low melting point and itself may not satisfactorily hold the conductors in relative positions due to heat from the molding-material, the conductors still will be clamped in such relative positions. Therefore, the invention facilitates or makes possible use of relatively inexpensive, low melting point cable in the termination system 10.

An example of a connecting portion 22 illustrated herein is that known as a Hirose connector, which is available commercially. The exemplary connector portion 22 includes a hollow shell-like housing 23 in which contact portions 24 are contained and are exposed sufficiently for connection with another device. The connector portion 22 also includes a base 25 in which the terminals 21 are retained, as by plastic injection molding directly to the terminals or by some other molding technique. The shape of the base 25 is configured to fit securely in an opening 26 in the strain relief body 15. Additionally, due to the strength and configuration of the respective portions of the termination assembly 10, it may have a lower over-all profile relative to prior devices.

Figure 2:
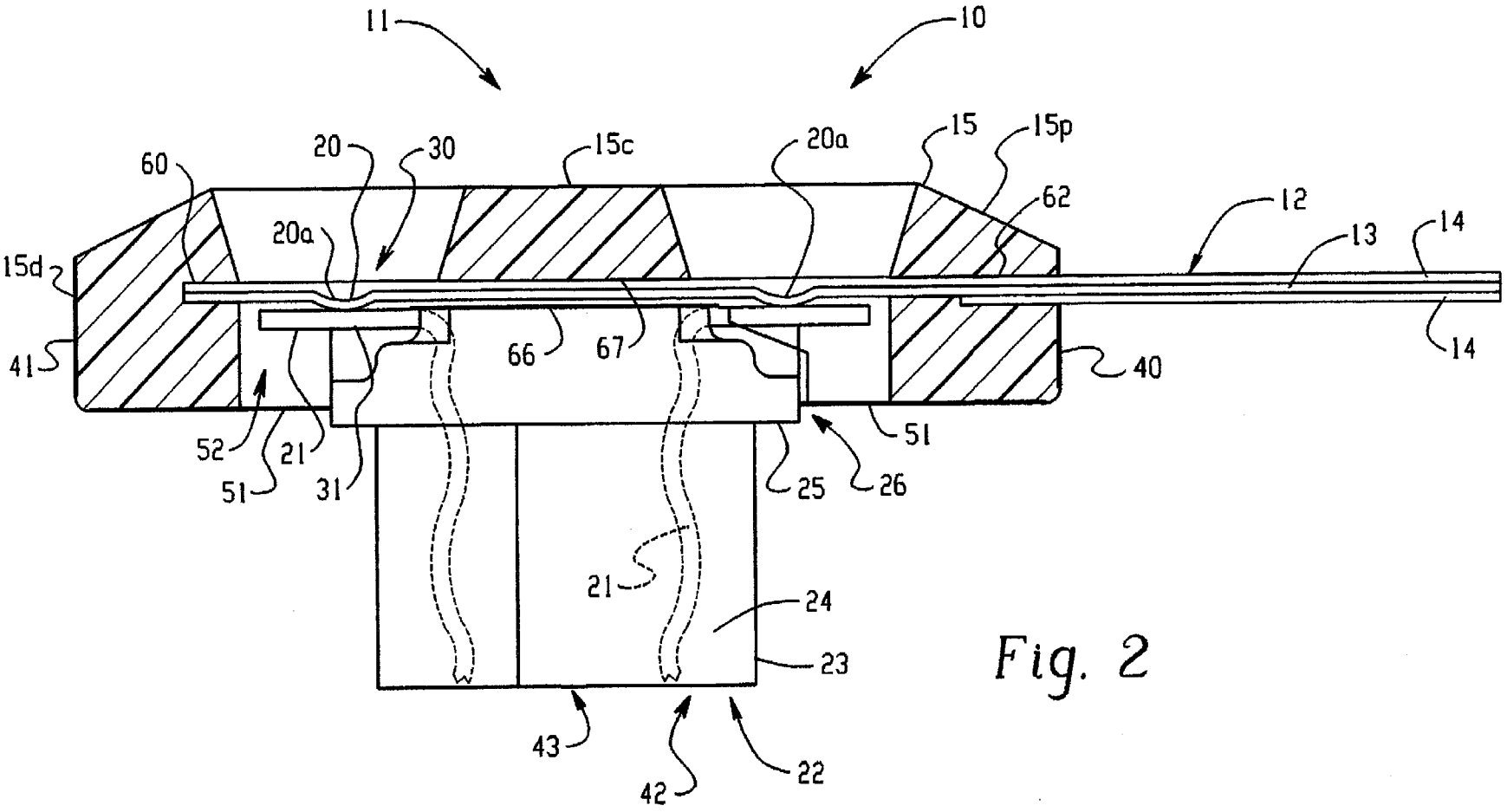
FIG. 2 is an enlarged side view similar to that of FIG. 1 but partly broken away in section to show various portions of the cable termination assembly.
Figure 3:
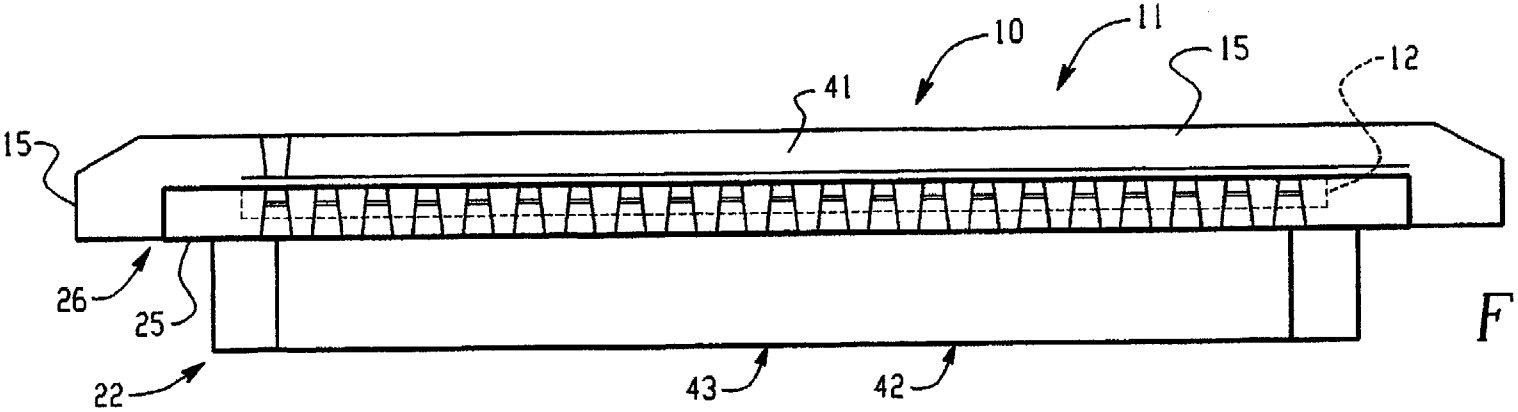
FIG. 3 is a distal end view (atop view relative to the illustration of FIG. 1) looking generally in the direction of the arrows 3—3 of FIG. 1.

As is seen in FIG. 2, the junctions 30 are established between connecting portions 20 of respective electrical conductors 13 of the cable 12 and the terminals 21. The connecting portions 20 may be knuckled or otherwise deformed to help assure engagement with respective terminal connecting portions 31 of the terminals 21. By upsetting a part **20*a* of the connecting portions 20 out of the plane of the traces which form the conductors 13, for example, space is provided for solder to reside when it is re-flowed to avoid forcing the re-flowed solder toward the center of the connector where it might cause a short circuit. The upset part 20*a* may be formed during the molding process for the strain relief body 15. Therefore, the accuracy or control of the amount of solder used does not have to be as severe as was required in some prior connector systems, as the space provided at the deformed part 20*a* increases tolerance to variations in the amount of solder used. If desired, though, the connecting portions 20 may be linear or flat without distortion, and the terminal connecting portions 31 may be linear or flat and at least to some extent overlie and engage with a conductor 13 over a length thereof. The junctions 30 also may be made and/or secured by a solder connection between respective electrical conductors 13 and terminals 21. Such solder connection may be effected by applying a solder material to the terminal connecting portions 31 before installing the connector portion 22 into the strain relief body 15, for example. The solder may be applied to the terminal connecting portions 31 as a paste, by dipping into a solder bath, or by some other technique. The solder may be re-flowed by applying heat to it. Various techniques may be used to apply heat, such as, for example, induction heating, infrared heating, applying a hot bar, etc., placing the termination assembly 10 in a hot oven, all of which are conventional techniques. The actual technique used may depend on the ability of the material employed in the termination assembly 10** to withstand application of heat.

In the Hirose connector the terminals are arranged in two parallel rows. Accordingly, the junctions 30 are arranged in two corresponding parallel rows. In one embodiment the junctions 30 and terminals 21 of one row are offset from those of the other row by a distance equal to the pitch of electrical conductors 13. Therefore, respective relatively adjacent conductors are connected to terminals of different rows. This is but one example of the positional pattern or arrangement of the terminals and the connections thereof to conductors 13; it will be appreciated that other patterns or arrangements also may be used.

As is seen in FIGS. 2–7, the strain relief body 15 is somewhat in the form of a frame-like structure. At the proximal frame end 40 the cable 12 enters the strain relief body. Although the cable stops and does not extend beyond the distal end 41 of the strain relief body 15 in the illustrated embodiment, if desired, the cable may extend beyond the distal end 41 for exposure for other uses, such as use in another termination assembly, attachment to a circuit board or other cable.

At the front 42 of the termination assembly 10 the connector portion 22 is open at 43 to provide access to the contact portions 24 of respective terminals 21. Another devices such as a connector, circuit board or the like, may be inserted into the open area 43 to provide for electrical connections between circuits, contacts or other conductive member of such device and respective contact portions 24 of the terminals 21. A number of divider or separator walls 44 may be provided in the housing 23 to separate respective terminals 21 from each other and to guide respective conductive members of the device inserted into the opening 43 to engagement with individual terminals.

Figure 6:
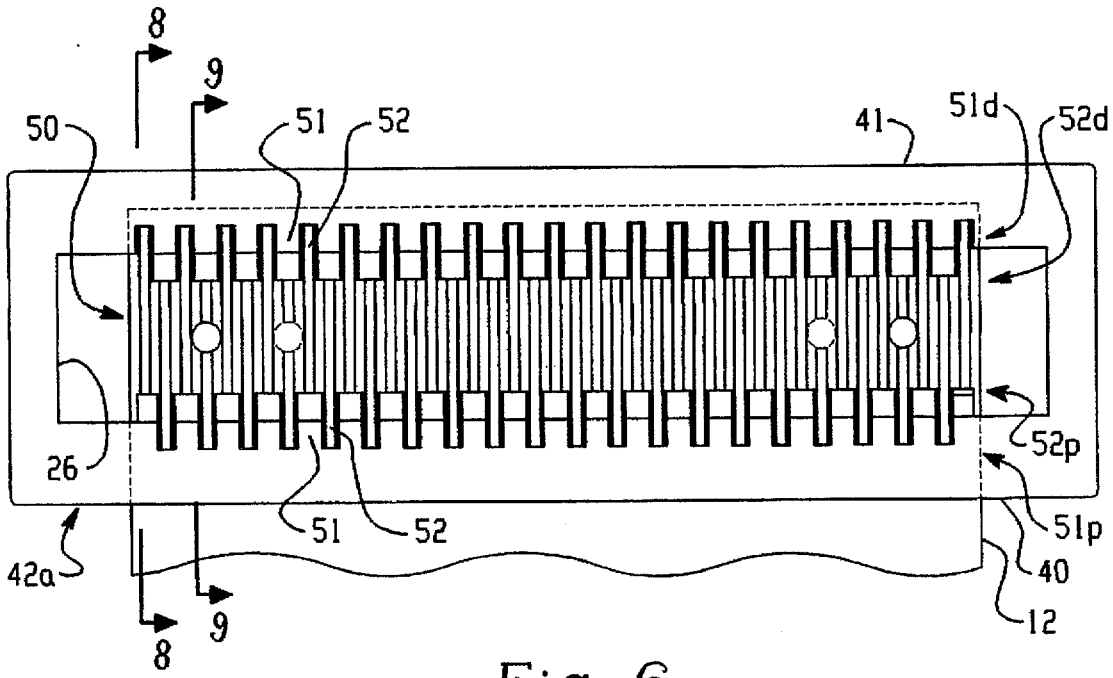
FIG. 6 is a front plan view of the strain relief body of the cable termination assembly looking in a direction similar to that represented by the arrows 5—5of FIG. 1 but prior to installation of the connector housing.
Figure 7:
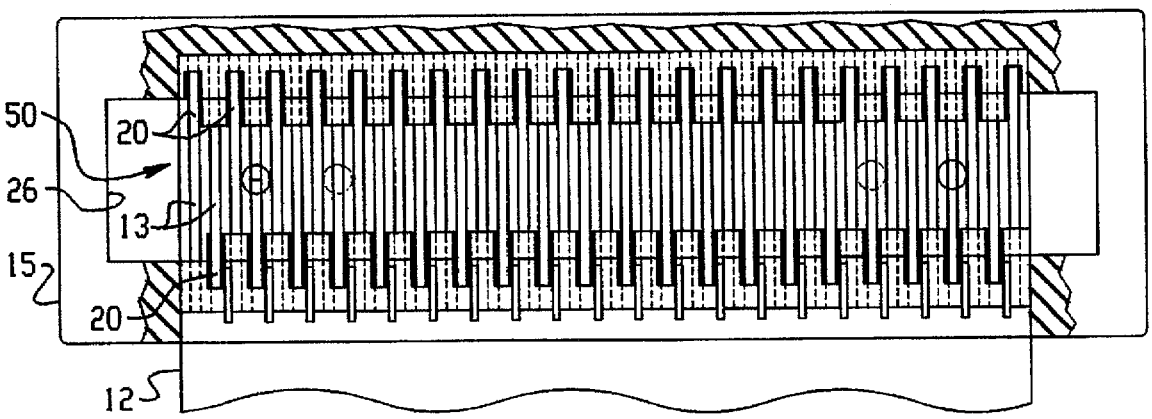
FIG. 7 is a view similar to FIG. 6 but also showing further details of the electrical conductors and mold-through slots in the cable.

As is seen in FIGS. 6 and 7, the opening 26 includes an open area 50 in the strain relief body 15. In the open area 50 the connecting portions 20 of the electrical conductors 13 are exposed. The parallel arrangement of those conductors 13 in the open area 50 is seen in FIGS. 6 and 7. Both FIGS. 6 and 7 are looking generally at the front portion 42*a* of the strain relief body 15. However, in FIG. 6 the front portion 42*a* is seen in full, whereas, in FIG. 7 the strain relief body 15 is broken away in section in the area of the cable 12 to show the cable itself in full.

In FIGS. 6 and 7 is illustrated a plurality of barriers 51, sometimes referred to as lands or dividers. Each divider 51 cooperates with the relatively adjacent divider to bound respective slots 52. Within respective slots are exposed the connecting portion 20 of respective electrical conductors 13. The dividers 51 are arranged in two rows 51*p* (closer to the proximal end 40 of the strain relief body 15 ) and 51*d* (closer to the distal end 41 ). The dividers 51 in one row are relatively offset from the dividers in the other row by an amount equal to the pitch of the electrical conductors 13. Therefore, the dividers in the row 51*p* overlie a portion of respective electrical conductors, but there is no corresponding divider in the row 51*d* which overlies the same electrical conductor. Rather, in view of such offset of the dividers 51, the slots 52 in the proximal row 52*p* of slots expose and provide access to respective electrical conductors 13 therein, and those electrical conductors are covered in part by a respective divider 51 in the distal row 51*d* thereof, and vice versa.

Accordingly, the slots 52 as bounded by respective dividers provide data sites or locations to guide respective terminal connecting portions 31 of respective terminals 21 into connection with connecting portions 20 of respective electrical conductors 13. Such guiding function helps to assure accurate positioning of the terminal connecting portions 31 into engagement and connection with individual electrical conductors 13, facilitates such positioning and connection, and also facilitates installing the connector portion 22 in the strain relief body 15.

As is seen in FIG. 2, the leading end 60 of the cable 12 is molded in the frame-like member 15*d* at the distal end 41 of the strain relief body 15; and the trailing end 61 of the cable where it exits the strain relief body is molded in the frame-like-member 15*p* at the proximal end 40 of the strain relief body. Another central frame-like member 15*c* extends across the width of the strain relief body 15 and has a surface 62 facing the cable 12 and against which the cable is supported in the strain relief body between the respective rows of junction zones 30*p*, 30*d* where the junctions 30 are made.

Figure 4:
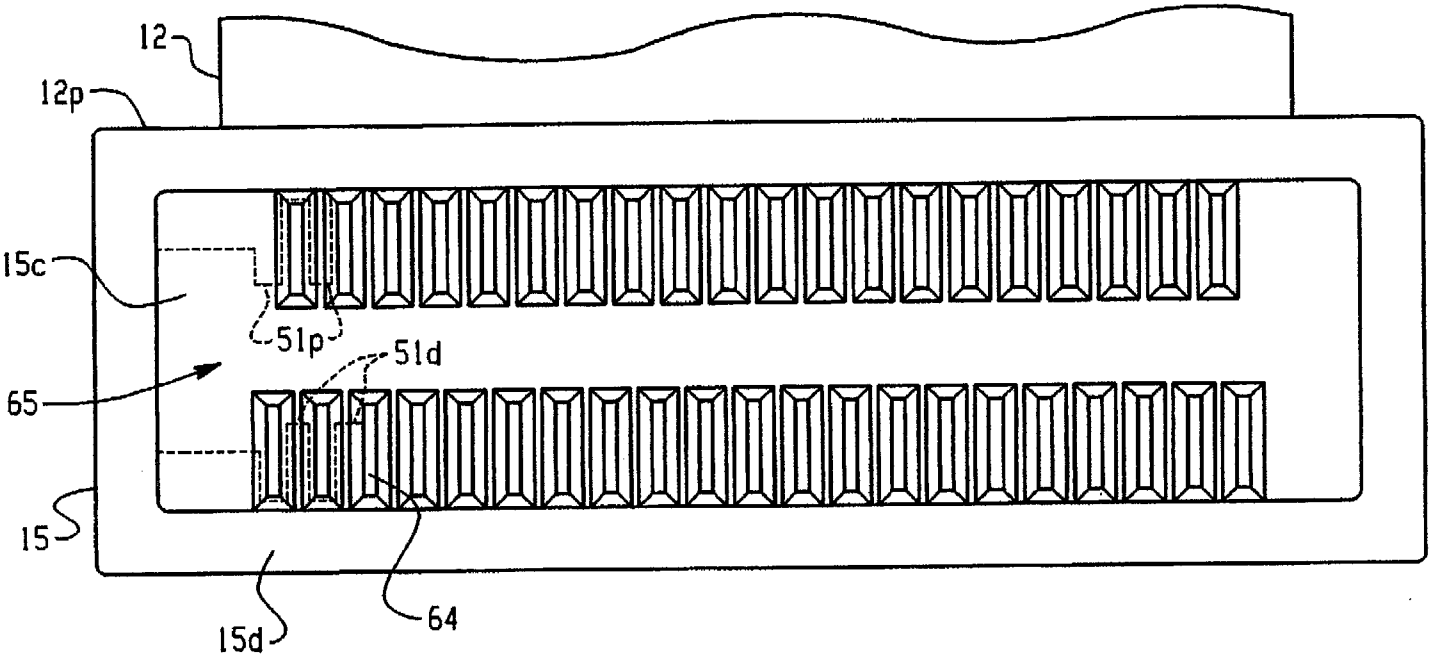
FIG. 4 is a back view (a right side view relative to the illustration of FIG. 1) looking generally in the direction of the arrows 4—4 of FIG. 1.
Figure 5:
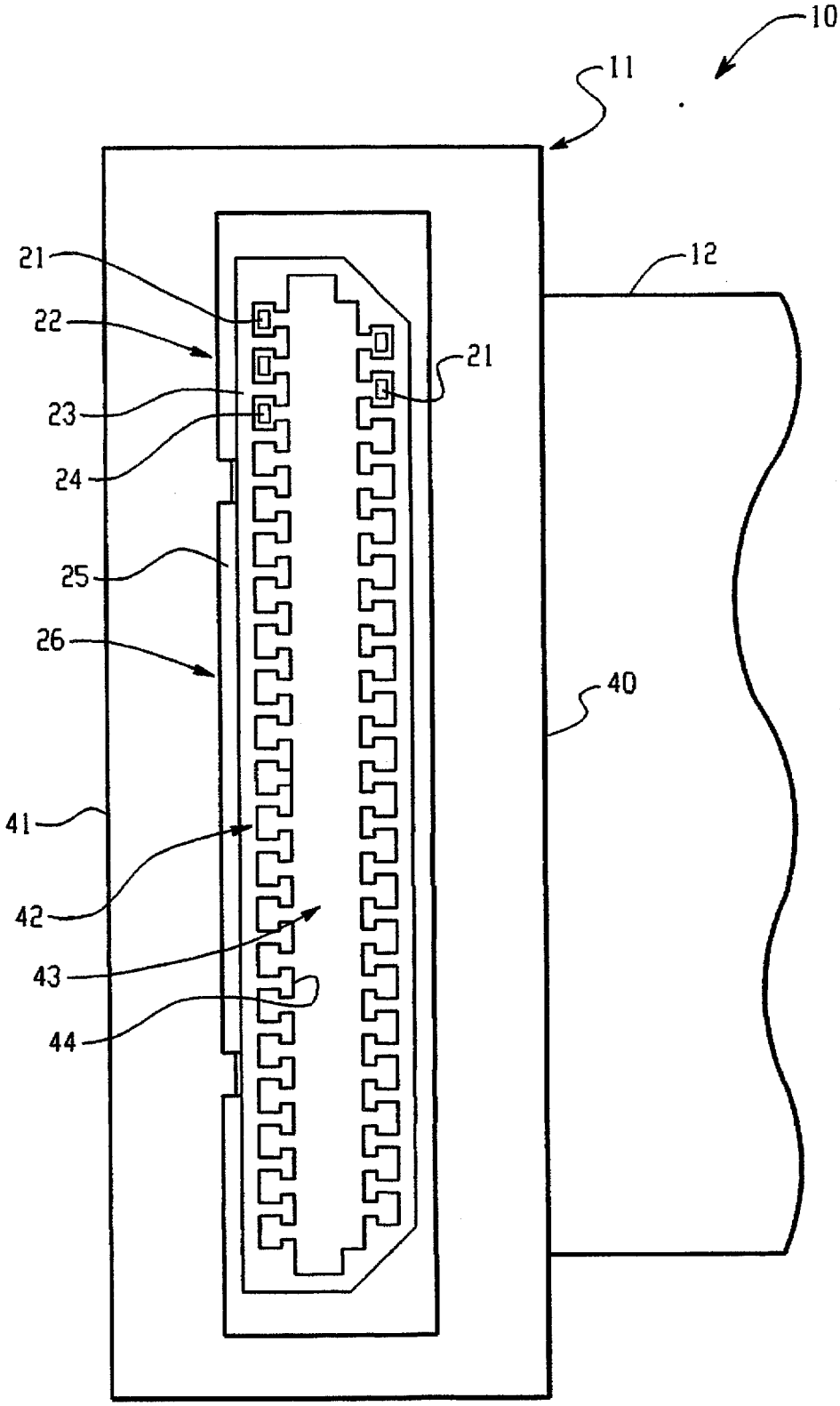
FIG. 5 is a front view (a left side view relative to the illustration of FIG. 1) looking generally in the direction of the arrows 5—5 of FIG. 1.

In FIG. 4 where the back 63 of the termination assembly 10 is seen, the central frame-like member 15*c* also is shown extending across the width of the strain relief body 15. A number of openings 64 lead from the exterior back surface 65 of the strain relief body 15 toward the area 50 in the strain relief body where the cable 12 is located. The openings 64 are places where mold cores are placed into engagement with the cable 12 behind respective conductors to cooperate with an oppositely located mold core to clamp the cable at such conductor in relatively fixed position while material is injected into the mold to mold the strain relief body 15. The openings 64 are aligned with respective slots 52. Therefore, the mold cores which define the openings 64 cooperate with the mold cores which define the slots 52; and the cable is clamped between those mold cores.

Rib-like members 66 shown in FIGS. 2 and 4 in the back 63 of the strain relief body 15 separate respective openings 64. The rib-like members 66 are aligned with portions of respective dividers or lands 51, some of which are shown in dotted outline in FIG. 4, for example, and provide the function of further supporting and clamping the cable 12 in position in the strain relief body 15 after molding. The rib-like members 66 also provide support for the central frame-like member 15*c*, holding it in relatively fixed relation to the frame-like members 15*p*, 15*d*, especially as the base 25 of the connector portion is inserted fully into the opening 26 sandwiching the cable 12 between the respective surfaces 67, 68 of the base and central frame-like member 15*c*. Such sandwiching helps further to retain the cable and conductors thereof in relatively fixed position in the strain relief body after the termination system has been assembled and while it is subsequently used.

Figure 8:
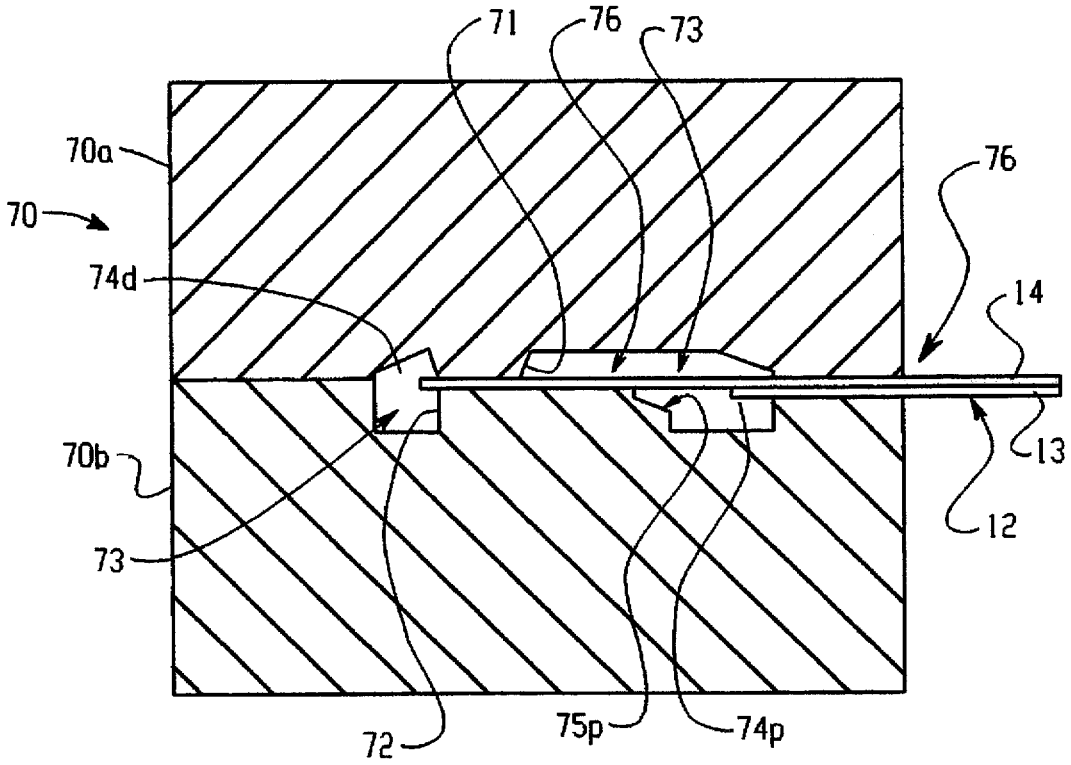
FIGS. 8 and 9 are schematic section view illustrations of a mold useful for making a cable termination assembly of the invention, the views representing the portions of the mold for molding the strain relief body at locations represented by arrows 8—8 and 9—9 of FIG. 6, respectively.
Figure 9:
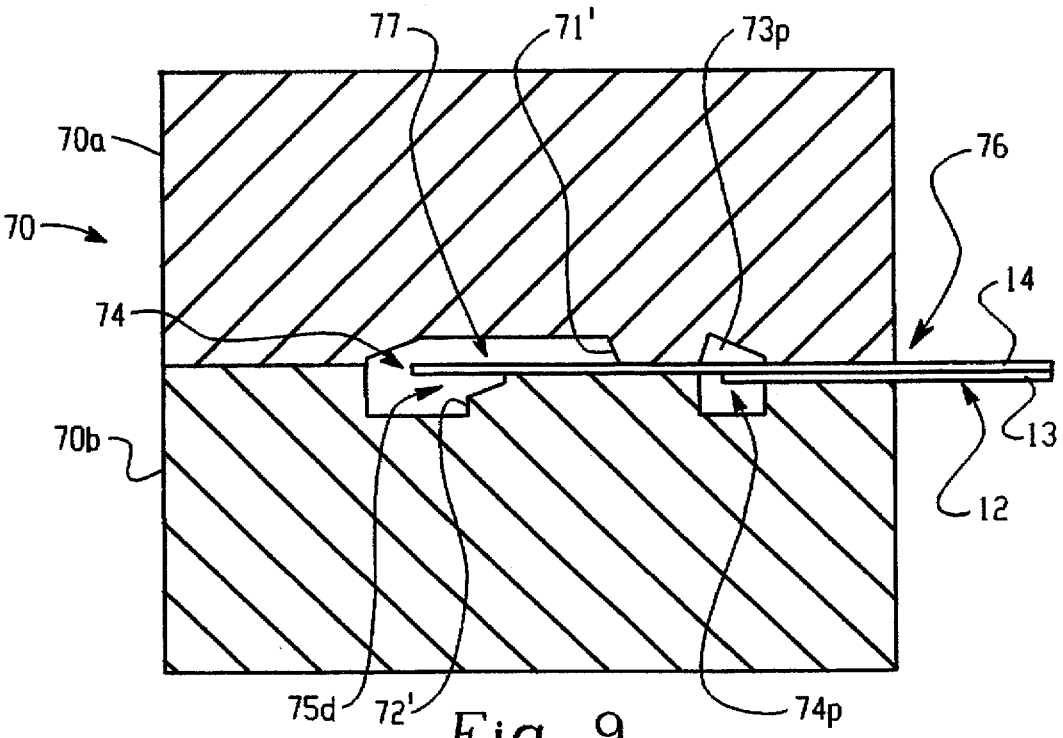

Turning to FIGS. 8 and 9, a schematic illustration of a mold 70 for making a cable termination assembly 10 in accordance with an embodiment of the invention is illustrated. The mold halves 70 a, 70 b are shown in section in FIGS. 8 and 9, respectively, at different locations along the width of the mold to illustrate the technique for clamping the cable 12 during molding of the strain relief body 15 and for forming the respective dividers 51, rib-like members 66, frame-like members 15*p*, 15*d* and 15*c*, and so forth. The cable 12 is clamped in position in the mold 70 by closure of and engagement with the mold halves 70*a*, 70*b*. The mold half 70*a* has respective mold cores 71, 71', which alternate in staggered relation along the width of the mold. The mold half 70*b* has respective mold cores 72, 72' which cooperate with respective mold cores 71, 71' to clamp the cable and electrical conductors in the mold. The mold cores 72, 72' may be tapered at respective ends or have sloped surfaces at the end adjacent where a respective divider 51 is to be formed; the shape or style of such taper may vary as a function of the desired shape of the land.

Using the mold 70 to mold the strain relief body 15 directly to the cable 12,the cable from which the insulation has been removed to expose connecting portions 20 of respective conductors is placed in the open mold. The mold 70 is closed, as is illustrated in FIGS. 8 and 9, to clamp the cable and conductors in relatively fixed position therein both by the respective mold cores 71, 71', 72, 72' and by the mold halves 70*a*, 70*b* where the cable enters the mold at 76. Plastic is injected into the mold to form the strain relief body 15.

In the mold cavity 73 cavity areas 74*d*, 74*p* fill with plastic during molding of the strain relief body to form the respective frame-like members 15*d*, 15*p*, respectively. The cavity areas 75*d*, 75*p* fill with plastic during molding to form the respective dividers 51*d*, 51*p*, and the relatively adjacent mold cores 72, 72' define the areas where respective slots 52 are located. The openings 64 are formed by the mold cores 71, 71'. The central frame-like member 15*c* is formed by plastic that fills the cavity area 77 where neither of mold cores 71, 71' is placed.

Since the strain relief body 15 is molded directly to the cable 12 or other substrate and/or to the conductors 13 before the terminals 21 are connected to the conductors, there is no need to use a separate dielectric contact or terminal carrier nor is there a need to mold the strain relief over such a carrier. As a result, the overall height profile of the strain relief body may be relatively lower or smaller than in conventional termination systems the ability to reduce size or profile of the cable termination of the invention also is enhanced by the efficient way in which the cable and conductors are clamped during the process of molding the strain relief body 15 thereto and are retained in position by the strain relief body after molding thereof.

Figure 10:
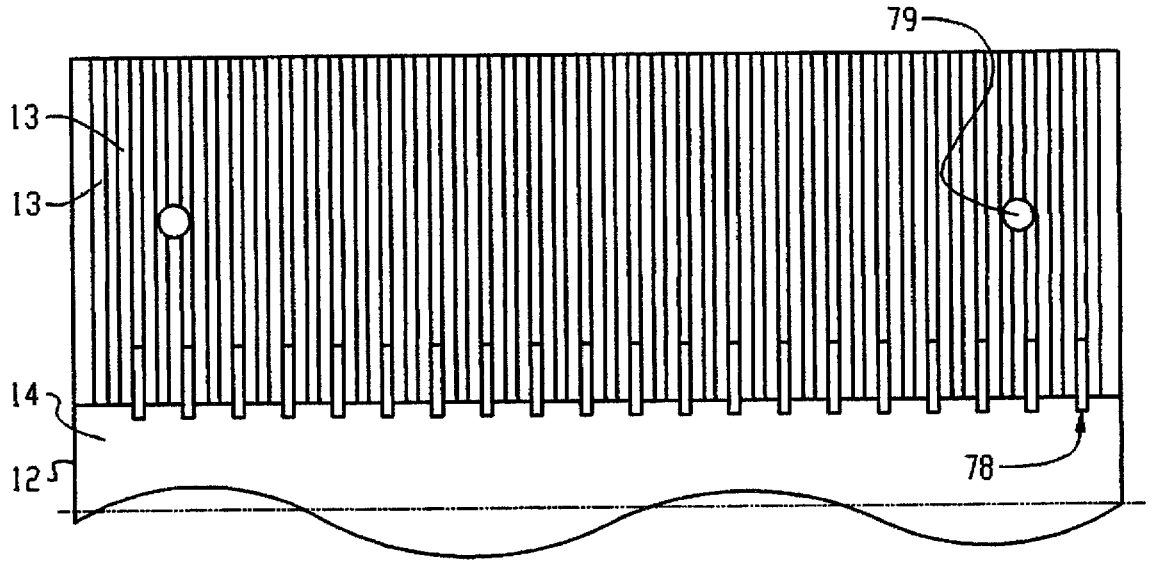
FIG. 10 is a top plan view of an FFC or flex circuit electrical cable used in the illustrated embodiment of cable termination assembly in accordance with the invention.

If desired, as is illustrated in FIG. 10, the cable 12 may be prepared by cutting one or more openings, such as slots 78, through the cable preferably without damaging the conductors 13. The slots 78 may be so located that plastic material which forms one or both of the frame-like members 15*d*, 15*p* will flow through the slots during the molding process to secure the cable 12 in the strain relief body 15, for example, helping to prevent the cable from being pulled out of the strain relief body. The slots 78 may be formed by a cutting die, by laser cutting or by some other technique. One or more additional openings 79 may be cut through the cable 12 at respective locations along the width of the cable to help secure the cable in the strain relief at the open area 50.

After the strain relief 15 has been molded to the cable 12, the base 25 of the connector portion 22 is placed in the opening 26. During such placing, the slots 52 guide respective terminal connection portions 31 of terminals 21 into engagement with connecting portions 20 of respective electrical conductors 13. After such placement, solder which was previously applied to the terminal connection portions 31 is reflowed to complete the junctions 30. The dividers 51 provide a barrier during such soldering to block the flowing (lateral flow) of solder to other electrical conductors 13 or terminal connection portions 31, which otherwise might cause a short circuit.

The cable 12 may be any of a variety of cable types. Examples include FFC, etched circuits, circuits on Kapton film, laminated circuits or cable, cables with electrically conductive shields, or the like. Some prior devices have used potting material to protect the connections of respective electrical conductors and terminals; however, potting is a slow and expensive process and results in a relatively large size device. In the past many cable termination systems which employed plastic injection molding techniques suffered from the technical difficulties of short circuits, open circuits, and other problems if the dielectric material of the cable would deteriorate, e.g., melt or soften, due to the high temperature of the injected plastic and allow the conductors to move. These difficulties also may be encountered as a result of applied heat for soldering or other securement of the junctions 30, for example.

However, in the present invention the cable 12 and conductors 13 thereof are clamped relatively securely by the mold 70 during molding. Therefore, movement of conductors from expected locations is avoided. Further, since in the invention soldering is carried out after the strain relief body 15 has been molded and the conductors have been secured in position by the molded plastic, the consequence of damage to the cable insulation due to soldering temperature would not be reduced or eliminated. Additionally, the barriers provided by respective dividers 51 of the strain relief body 15 avoid lateral flowing of the solder and possible short circuits resulting from such unintended flow.

As a result, the cable used in the invention may be either relatively expensive cable 12 having heat resistant insulation/dielectric material or it may be relatively inexpensive cable, such as that which uses polyester insulation, which has a relatively low melting temperature.

The connecting portions 20 of the electrical conductors 13 may be soldered to respective terminal connection portions 31 using conventional solder that is re-flowable. Also, if desired, other materials may be used to secure mechanically and electrically the respective junctions 30; an example of such material is a conductive adhesive material, which does not require re-flowing or heating.

Application of heat energy to effect re-flowing of solder may be by various means and techniques. One such technique is that of induction heating in which an electromagnetic field is applied to the material, such as the conductors 13 and terminals 21, in the area of the junction 30. The field produces eddy currents in the electrically conductive material, which causes heating of the material and re-flowing of the solder. In one embodiment the induction heating may be applied at a relatively low power level of, for example, 3–4 kw. Such power may be applied for about 10 seconds and more preferably on the order of about 7 seconds. In another embodiment, the induction heating may be applied at a relatively higher power level of, for example, 6–7 kw. Such power may be applied for less than about 1 second and has been found satisfactory to provide sufficient heating to re-flow the solder without substantial damage to the cable or other portions of the termination assembly 10.

Other techniques to secure the connection portions 20 with the terminal connecting 31 also may be used. An example of such other techniques is welding.

It has been found that in many instances the connection of the terminal connecting portions 31 to the connecting portions 20 of the cable 12 conductors 13 by soldering is sufficient to secure the connector portion 22 to the molded strain relief 15. However, if desired, the dividers 51 may include a portion that is upstanding adjacent a slot 52 and that can be heated and deformed to stake against the terminal connecting portion urging it and holding it in engagement with a connecting portion 20 of a respective electrical conductor 13.

Figure 11:
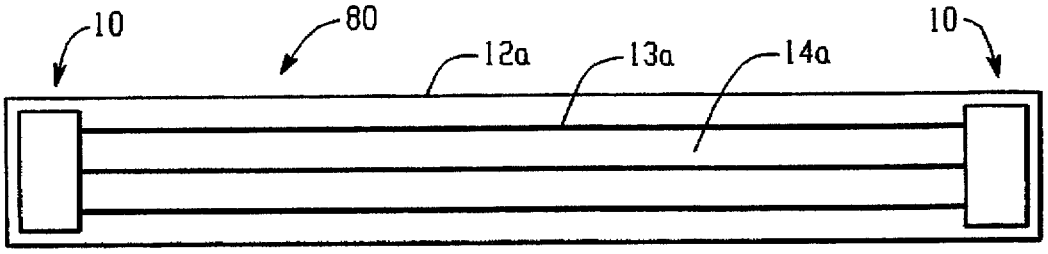
FIG. 11 is a schematic top plan view of a cable termination assembly for an FFC.

Briefly referring to FIGS. 11–14, examples of use of the termination system 10 of the invention are illustrated. In FIG. 11 there is a cable system 80 including an FFC electrical cable 12*a* formed of a dielectric material/insulation substrate 14*a* for example a laminated polyester material, and plural electrical conductors 13*a*. At each end of the cable 12*a* is a respective termination assembly 10. The termination assemblies 10 may be connected to respective devices for connecting circuits of those devices to each other via the system 80.

Figure 12:
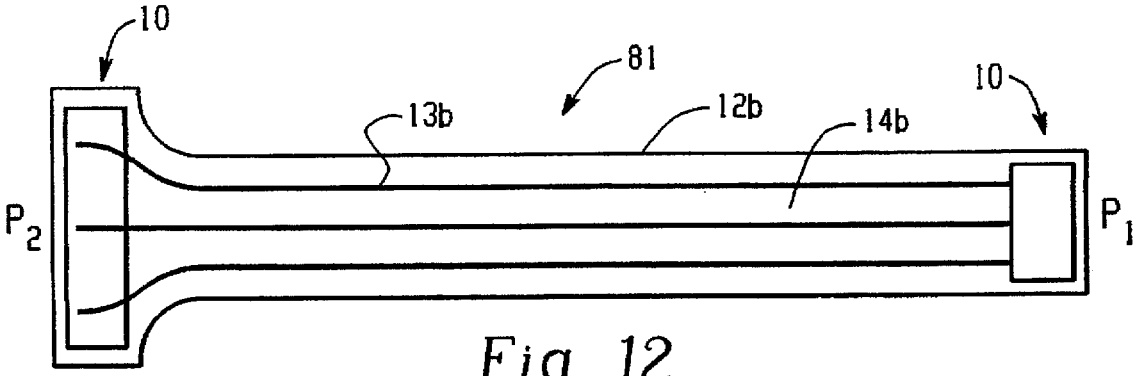
FIG. 12 is a top plan view of a cable termination assembly used with an etched circuit for changing pitch of the conductors.

In FIG. 12 there is a cable system 81 including an etched circuit 12*b*, such as one formed of Kapton film insulation as substrate 14*b*, having plural conductors 13*b*. Kapton film is relatively expensive, although it has a relatively high melting point; but, if desired, an etched polyester insulation substrate and respective conductors also may be used in accordance with this embodiment of the invention. A cable termination 10 is at each end of the etched circuit 12*b*. The pitch of the electrical conductors 13*b* changes from one end of the etched circuit 12 b to the other; for example, from the right hand to the left hand, as viewed in the drawing, the pitch fans out. The termination assemblies 10 at the respective ends of the etched circuit 12*b* may be connected to respective devices that have different contact spacing/pitch for connecting circuits of those devices to each other via the system 81.

Figure 13:
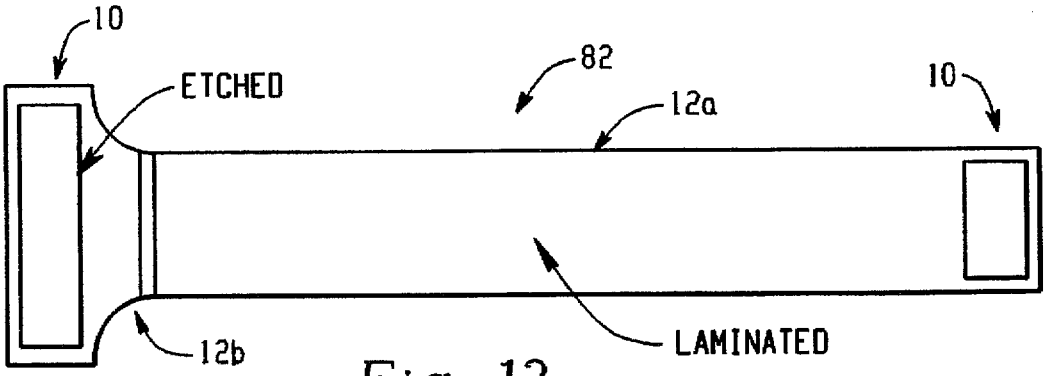
FIG. 13 is a top plan view schematic illustration of a combination of etched circuit and laminated cable for changing pitch and including respective cable terminations at the opposite ends.

In FIG. 13 there is a hybrid cable system 82 including an etched circuit **12*b*, such as one formed of Kapton film insulation substrate 14*b* having plural electrical conductors 13*b*, as in the above-described etched system. 81, and a FFC 12*a* having a laminated insulation substrate 14*a* with electrical conductors 13*a*, as in the above-described laminated system 80. A termination assembly 10 is at each end of the hybrid cable system 82. The etched circuit 12*b* facilitates making a change in pitch as was describe above for the system 81, although the etched circuit is relatively expensive. To reduce the cost for a relatively lengthy connection provided by the hybrid cable system 82, the laminated system 80 also is used. The conductors 13*a* of the laminated system 80 are connected to respective conductors 13*b* of the etched system 81; and the system 82** may be used to connect, over a relatively long distance, respective devices that have different contact spacing/pitch.

Figure 14:
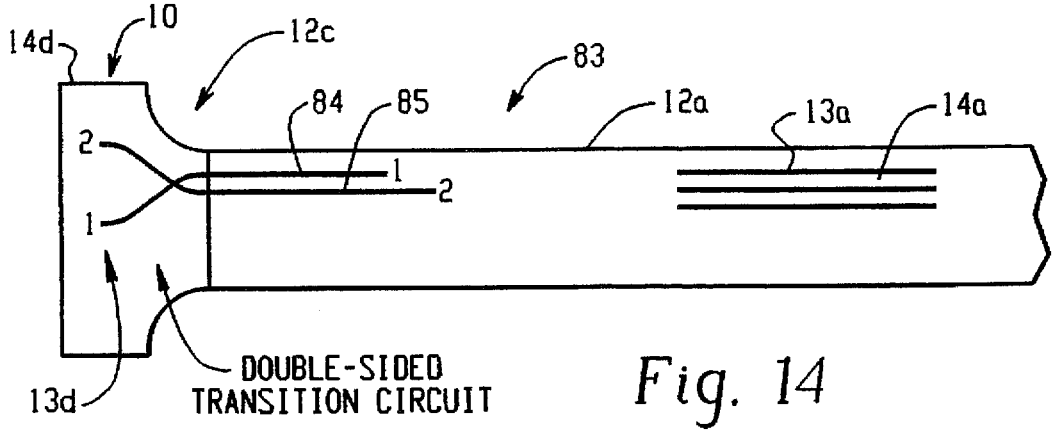
FIG. 14 is a schematic top plan view of a combination of a flex circuit and FFC with a cable termination according to the invention and having cross over conductor capability.

In FIG. 14 there is a cross-over and/or fan-out type of hybrid cable system 83 including an etched circuit **12*c*, such as one formed of a circuit board substrate 14*d* on which plural circuits are formed, as by printing, etching or some other technique, having plural electrical conductors 13 d, and a laminated or FFC insulation substrate 14*a* having electrical conductors 13*a*, as in the above-described laminated system 80. A termination assembly 10 is at each end of the hybrid cable system 83. The circuit board substrate 14*d* is a double sided (or multi-sided) one having circuits or conductive paths on both sides and also having one or more vias or edge connections to connect a circuit from one side to the other of the circuit board. By arranging the respective conductive paths and connections from one side to the other of the circuit board through vias on edge connections, the locations of respective signal conductors of the cable 12*a* may be changed, switched, etc. at the circuit board. For example, the relative locations of two conductors 84, 85 may be switched. The system 83** may be used to connect, over a relatively long distance, respective devices that have different contact spacing/pitch and/or different positions for respective signals.

Figure 15:
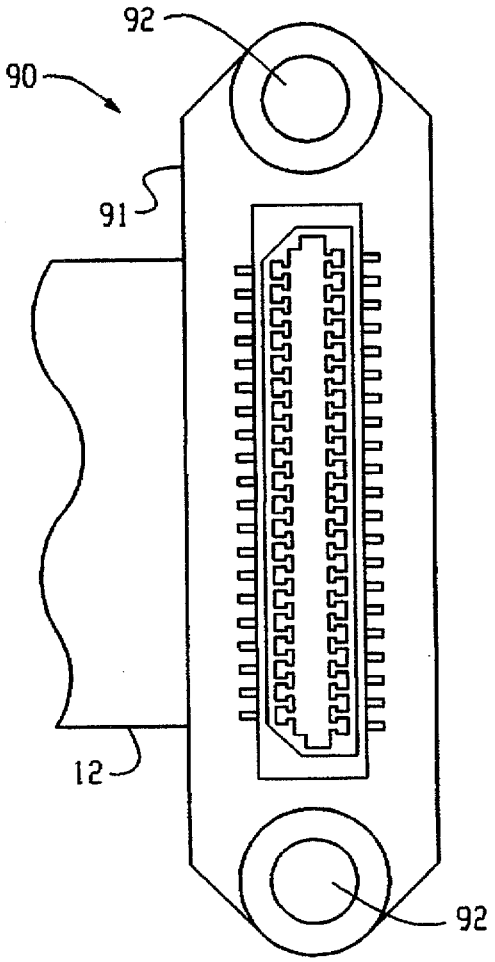
FIG. 15 is a front view of a modified cable termination assembly with hold-down mechanism.

In FIG. 15 an alternate embodiment of termination system 90 is shown in which the strain relief base 91 includes a number of screw holes 92 for attachment by screws either to another connector or to a support structure; Screw fasteners, other resilient fasteners, clip type fasteners or other fasteners may be used to mount the termination system 90 to a support, another connector or other device. The termination system 90 may be otherwise the same or similar to those described above.

Industrial Application

It will be appreciated from the description above that the termination system and method of the present invention may be used to make electrical connections between respective devices; and the method facilitates making such termination assemblies.

The embodiments of the invention claimed are, as follows:

1. A termination comprising:

a substrate having a plurality of electrical conductors, a strain relief frame molded to the substrate, a connector housing separate from the frame and having a plurality of electrical terminals positioned with respect to the frame to orient the terminals with respect to the conductors, and a plurality of the terminals being directly electrically connected to respective electrical conductors.

2. The termination of claim 1, the electrical conductors being in spaced parallel relation, the strain relief frame including a plurality of spacers arranged in a pair of respective parallel rows generally transverse to the parallel directional extent of the electrical conductors for guiding respective terminals into alignment for connection with respective electrical conductors.

3. The termination of claim 2, wherein a pair of relatively adjacent spacers in one row thereof have a conductor exposed therebetween and overlie respective other conductors which are exposed for connection in the other row of spacers.

4. The termination of claim 2, wherein said strain relief is plastic injection molded.

5. The termination of claim 4, wherein said strain relief is molded directly to the substrate.

6. The termination of claim 1, wherein said strain relief frame holds conductors in position relative to each other and to the strain relief frame.

7. The termination of claim 1, said terminals being arranged in plural rows, the terminals in one row being electrically connected with selected electrical conductors, and at least some of the terminals in another row being electrically connected with other electrical conductors.

8. The termination of claim 7, said terminals being arranged in a pair of parallel rows.

9. The termination of claim 1, said connector housing being pre-formed.

10. The termination of claim 1, said strain relief frame including a plurality of guides for guiding portions of respective terminals to connection with respective electrical conductors, said guides including a plurality of dividers, at least some of said dividers being arranged in overlying relation, respectively, to at least one electrical conductor while leaving another electrical conductor exposed between a relatively adjacent pair of such dividers.

11. The termination of claim 14, wherein the terminals include connecting tails for parallel alignment and engagement with a portion of respective electrical conductors, wherein a plurality of said guides include a deformed portion overlying said connecting tails for holding the connecting tails in position connected to respective electrical conductors.

12. The termination of claim 1, wherein the terminals are soldered to respective electrical conductors.

13. The termination of claim 12, wherein a plurality of said electrical conductors are deformed from the major directional extent thereof to provide a space between respective conductors and solder tails for the accumulation of solder.

14. The termination of claim 12, wherein the terminals are soldered to respective electrical conductors by induction soldering.

15. The termination of claim 12, wherein the terminals are soldered to respective electrical conductors by adhesive soldering.

16. The termination of claim 1, wherein the terminals are connected to respective electrical conductors by welding.

17. The termination of claim 1, said substrate comprising a flexible flat cable.

18. The termination of claim 17, said flexible flat cable comprising plural electrical conductors and electrical insulation separating respective conductors and holding such conductors in positional relation to each other.

19. The termination of claim 18, said electrical insulation comprising polyester material.

20. The termination of claim 18, wherein the conductors are respective traces on said electrical insulation and are connected to respective terminals by solder, and wherein a portion of said conductors is deformed relative to the major planar extent of said traces to provide space to accommodate reflowed solder to avoid short circuits.

21. The termination of claim 17, said cable comprising Kapton film.

22. The termination of claim 1, said substrate comprising an etched circuit.

23. The termination of claim 1, said substrate comprising a relatively rigid member.

24. The termination of claim 1, said substrate comprising a circuit board.

25. The termination of claim 24, said electrical conductors comprising conductive traces of the circuit board.

26. The termination of claim 1, said substrate having respective surfaces and openings therein from one surface to the other, and at least a portion of said strain relief being molded at both surfaces and through said openings.

27. The termination of claim 1, wherein the conductors comprise plural spaced apart conductors carded by the substrate, and wherein said conductors have exposed portions for electrical connection, said strain relief frame is molded to hold the conductors in relatively fixed positional relation, an open area is in the strain relief body for exposing connecting portions of the conductors, said plural terminals each have ca connecting portion for connecting with respective exposed portions of said conductors, and said strain relief frame includes spacers for guiding respective connecting portions to connection with respective conductors and for physically separating respective connecting portions at the area of such connections.

28. The termination of claim 1, wherein the conductors comprise plural spaced apart conductors carried by the substrate, and wherein said conductors have exposed portions for electrical connection, the strain relief frame is molded to hold the conductors in relatively fixed positional relation, an open area is in the strain relief frame for exposing connecting portions of the conductors, said plural terminals each have a connecting portion for connecting with respective exposed portions of said conductors, the electrical conductors are in spaced parallel relation, and the strain relief frame includes a plurality of spacers arranged in a pair of respective parallel rows generally transverse to the parallel directional extent of the electrical conductors for guiding respective terminals into alignment for connection with respective electrical conductors.

29. The termination of claim 28, wherein a pair of relatively adjacent spacers in one row thereof have a conductor exposed therebetween and overlie respective other conductors which are exposed for connection in the other row of spacers.

30. The assembly of claim 28, said spacers being positioned to guide respective connecting portions to connection with respective conductors and for physically separating respective connector portions at the area of such connections, and wherein a plurality of said spacers include a deformed portion overlying said connecting portions for holding the connecting portions in position connected to respective electrical conductors.

31. The termination of claim 28, wherein the terminals are soldered to respective electrical conductors.

32. The termination of claim 31, wherein a plurality of said electrical conductors are deformed from the major directional extent thereof to provide a space between respective conductors and terminals for the accumulation of solder.

33. The termination of claim 1, said plural electrical conductors are in a pattern, said electrical terminals have connecting portions, and the strain relief frame includes plural slots for guiding respective connecting portions to connection with respective electrical conductors while separating respective connecting portions.

34. The termination of claim 33, further comprising a connector housing for retaining said electrical terminals in position for connection to an external device, and a receiving portion in said strain relief frame to receive a potion of said connector housing to retain said electrical terminals in relatively fixed positional relation to said electrical conductors where attached to said connecting portions.

35. The termination of claim 33, wherein said electrical conductors have a generally linear directional extent portion and said connecting portions of said electrical terminals also have a generally linear directional extent portion coextensive with and connected to part of said generally linear directional extent portion of respective electrical conductors.

36. The termination of claim 35, further comprising a solder connection between respective electrical conductors and connecting portions of respective electrical terminals.

37. The termination claim 36, said strain relief frame including blocking means for blocking flow of solder between areas of connection between respective electrical conductors and respective electrical terminals.

38. The termination of claim 37, wherein connecting portions of respective electrical conductors are deformed to provide space for solder during re-flowing of solder to make such solder connections.

39. The termination of claim 35, said strain relief frame comprising lands to establish data sites positioning respective connecting portions in alignment with respective electrical conductors.

40. The termination of claim 35, said substrate having respective surfaces and openings therein from one surface to the other, and at least a portion of said strain relief being molded at both surfaces and through said openings.

41. The termination of claim 33, said substrate including conductors having one pitch where connected to respective terminals and a different pitch for connection with another device.

42. The termination of claim 41, further comprising a further electrical cable coupled to said electrical conductors remotely of the connections thereof to respective electrical terminals.

43. The termination of claim 33, said substrate having two sides and including electrical conductors on both sides.

44. The termination of claim 43, said conductors including crossover conductors for changing the relative position of a conductor to the positions of other conductors of the substrate.

45. The termination of claim 1, wherein respective conductors are solder connected to respective terminals, and wherein such solder connections are made subsequent to molding of the strain relief flame to the substrate.

46. A method of making a termination, comprising;

molding a strain relief flame to a substrate having plural conductors in positional relation, said molding including leaving exposed connecting portions of respective conductors, subsequently directly attaching plural terminals supported by a separate connector housing to exposed connecting portions of said conductors.

47. The method of claim 46, said attaching comprising soldering respective terminals to respective conductors.

48. The method of claim 47, further comprising deforming connecting portions of respective conductors to provide space for solder during such soldering.

49. The method of claim 47, soldering comprising induction soldering.

50. The method of claim 49, said molding comprising forming barriers on both sides of respective conductors to block flow of solder that would cause a short circuit to an undesired conductor or terminal.

51. The method of claim 46, further comprising during said molding clamping said conductors to minimize movement thereof during molding.

52. The method of claim 46, said molding comprising molding lands to establish data sites for connection to respective exposed conductor portions by respective terminals.

53. A cable termination assembly made by the process of claim 46.

54. A termination comprising:

plural spaced apart conductor means for conducting respective electrical signals, substrate means carrying said conductor means, said conductor means having exposed portions for electrical connection, strain relief body means molded to the conductor means and to the substrate means for holding the conductor means in relatively fixed positional relation while providing strain relief function, an open area in the strain relief body means for exposing connecting portions of the conductor means, plural terminal means supported by a connector housing and each having a connecting portion for directly connecting with respective exposed portions of said conductor means, and said strain relief body means including spacer means for guiding respective connecting portions to connection with respective conductor means and for physically separating respective connecting portions at the area of such connections.

* * * * *